US007121201B2

(12) United States Patent
Landskron et al.

(10) Patent No.: US 7,121,201 B2
(45) Date of Patent: Oct. 17, 2006

(54) PRINTING PRESS FOLDER WITH AIR KNIFE

(75) Inventors: David Landskron, Menomonee Falls, WI (US); Darin Chic, Sussex, WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 10/156,500

(22) Filed: May 28, 2002

(65) Prior Publication Data

US 2003/0221569 A1 Dec. 4, 2003

(51) Int. Cl.
*B41F 13/24* (2006.01)
*B65H 5/02* (2006.01)

(52) U.S. Cl. ..... 101/232; 271/276; 271/314; 271/315

(58) Field of Classification Search ..... 101/232; 240/1–30; 271/271, 276, 314, 315, 182, 271/279

See application file for complete search history.

(56) References Cited

U.S. PATENT DOCUMENTS 4,373,713 A * 2/1983 Loebach ..... 271/303
4,451,028 A * 5/1984 Holmes et al. ..... 271/11
5,836,084 A * 11/1998 Jackson et al. ..... 34/107
6,116,595 A * 9/2000 d'Agrella et al. ..... 271/279
6,394,445 B1 * 5/2002 d'Agrella ..... 271/182

FOREIGN PATENT DOCUMENTS

CH 670441 * 6/1989
JP 11183181 * 6/1999

OTHER PUBLICATIONS

EXAIR Corporation, Standard Air Knife, pp. 10, 12, Available at least as early as Jan. 2001.
EXAIR Corporation, Super Air Knife, pp. 3-9, United States, Available at least as early as Jan. 2001.
EXAIR Corporation, Standard Air Knife Installation & Maintenance, Jan. 2001, United States.
Air Blast, Inc., Air Knives, http://www.thomasregister.com, Jan. 2001, Thomas Publishing Company, United States.
Sonic Air Systems, Inc., Blowers and Air Knife Drying Systems, http://www.sonicairsystems.com, Jan. 2000, United States.

* cited by examiner

*Primary Examiner*—Andrew H. Hirshfeld
*Assistant Examiner*—Marissa Ferguson-Samreth
(74) *Attorney, Agent, or Firm*—Michael Best & Friedrich LLP

(57) ABSTRACT

The folder of a printing press includes an air knife assembly to reduce damage to signatures as they travel through the folder and to guide signatures through the folder.

2 Claims, 4 Drawing Sheets

PRINTING PRESS FOLDER WITH AIR KNIFE

FIELD OF THE INVENTION

The present invention relates to the folder of a printing press, and, more particularly, relates to the use of an air knife in the folder.

BACKGROUND OF THE INVENTION

In web offset printing, a desired image is repeatedly printed on a continuous web or substrate such as paper. In a typical printing process, the continuous web is slit in the longitudinal direction (the direction of web movement) to produce a plurality of continuous ribbons. The ribbons are aligned one on top of the other, folded longitudinally, and cut laterally to produce a plurality of multi-page, approximately page-length segments, each of which is termed a signature. The term signature also encompasses a single printed sheet that has or has not been folded. Because more than one different signature can be printed at one time, it is often desirable to separate the different signatures by transporting successive signatures in different directions or paths.

One way to accomplish the sorting of a single stream of signatures is to use a diverter mechanism, such as a diverter wedge, to divert successive signatures to one of two paths. Once diverted, the signatures typically are transferred to a conveyor using rotating buckets (also known in the art as fans, fan wheels, paddle fans, or rotary flywheels).

Typically, two sets of rotating buckets assemblies are utilized, one set to deliver signatures traveling along a first path to a first conveyor and the other set to deliver signatures traveling along the second path to a second conveyor. Each set of bucket assemblies includes several individual buckets arranged at a spaced distance from one another along a common axis or shaft. Each bucket has multiple aligned blades that define pockets or slots between them for receiving signatures and transferring the signatures to the respective conveyor.

It is desirable to increase the operating speed of a printing press in order to increase the printed product output. However, as the rotational speed of the buckets is increased, it is more difficult to ensure the reliable operation of the buckets and to ensure that signatures are not damaged. For example, signature quality problems that can occur at higher press speeds include ink offset, dog-eared edges, and defects to both the leading and trailing edges of the signatures. These and other defects can lead to paper jams in the folder, resulting in press downtime and expense.

When the signatures are not snugly held between guide belts, the signatures may flutter or, when the signatures are folded signatures, the signatures may open partially. Signature fluttering and/or opening can result in damage to the signatures in the folder. Signatures may also "free fall" (i.e. travel without any belt guidance whatsoever) as they move through the folder, resulting in the potential for the signatures to flutter and/or opening.

SUMMARY OF THE INVENTION

The present invention provides a folder for a printing press including at least one air knife assembly to guide signatures through a portion of the folder. The folder includes a plurality of rollers and belts traveling in endless loops around the rollers. Signatures are diverted to one of two signature paths in a diverting section of the folder, and each signature path includes the air knife assembly. The air knife assembly generally includes at least one air knife positioned on a side of the signature path. The air knife provides a sheet of moving air traveling generally parallel to the signature path and assists in guiding signatures along the signature conveying path and into the delivery buckets.

Each signature path also preferably includes a delivery roller upstream of the signature slow down device. When the belts pass the delivery roller, the belts diverge from each other such that the signature is released from between the belts and free falls through a signature slow down device. As the signature free falls, the sheets of moving air from the air knife guide the signatures toward the delivery buckets. In this respect, the air knives are preferably positioned between the delivery roller and the signature slow down device. In addition to guiding signatures toward the delivery buckets, the sheets of air also serve to maintain folded signatures in a folded configuration as they move through the folder.

The present invention also provides a method for transporting signatures along a signature conveying path. Given the folder presented above, providing the sets of belts generally defines a signature conveying path. As the belts travel past the delivery roller, the belts are diverted away from the signature conveying path such that a signature carried by the belts is released and substantially free falls downstream of the delivery roller. Positioning the air knives adjacent the signature conveying path just downstream of the delivery roller allows the sheets of moving air to guide the signatures along the signature conveying path and into further downstream processing equipment, such as the delivery buckets. Providing the sheets of moving air also shuts folded signatures as the folded signatures travel along the signature conveying path.

Other features and advantages of the invention will become apparent to those skilled in the art upon review of the following detailed description, drawings, and claims.

Figure 1:
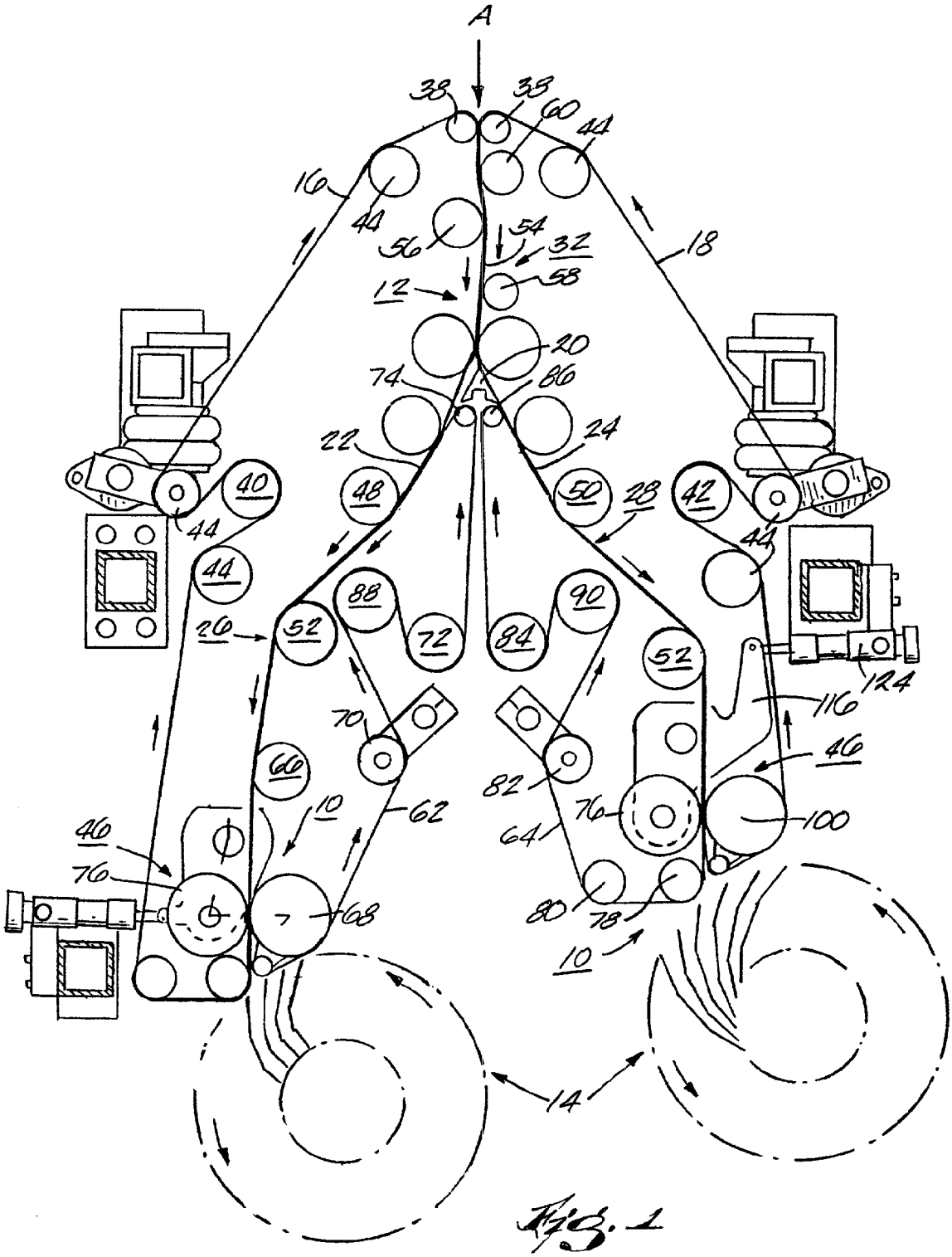
FIG. 1 is a schematic side view of a portion of a folder of a printing press embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

BRIEF DESCRIPTION OF THE PREFERRED EMBODIMENT

Schematically illustrated in FIG. 1 of the drawings is a portion of a folder of a web offset printing press that includes a pair of delivery sections 10, a diverting section 12 and a pair of rotary fan delivery devices 14. The present invention is applicable to many other types and models of high speed printing presses.

Successive folded and cut signatures enter the diverting section 12 at the arrow A and are received by driven diverter belts 16 and 18. The signatures are then diverted by a diverter wedge 20 into one of two signature or collation paths 22 and 24. Typically, the signatures are diverted alternately to path 22 then to path 24. The signatures enter a respective collating section 26, 28 and are fed along one of the collation paths 22 or 24 toward one of the rotary fan delivery devices 14 and subsequently to a conveyor (not shown). Prior to reaching the rotary fan delivery device 14, the signatures travel through a respective delivery section 10.

Signatures are routed through the diverting section 12 to a selected one of the collation paths 22 or 24 by the diverter belts 16, 18 which are in opposed face-to-face relation with each other and disposed over rollers in an endless belt configuration. The diverter belts 16, 18 circulate in separate continuous loops in the directions shown by the arrows in FIG. 1 and are joined at a nip between a set of idler rollers 38 near the upper portion of the diverter section 12. Drive rollers 40 and 42 drive the diverter belts 16 and 18 respectively about, among other components, the idler rollers 38, a plurality of additional idler rollers 44, a trailing edge signature slow down mechanism 46, and idler rollers 48 and 50. The diverter belts 16 and 18 are driven around delivery rollers 52. Both diverter belts 16 and 18 are driven by respective drive rollers 40 and 42 at the same speed, which typically is from 8% to 15% faster than the paper speed through the printing press. The faster speed of the belts 16 and 18 causes a gap to occur between successive signatures as the signatures flow through the diverter section 12. As the signatures enter the diverter section 12, a soft nip 54 provided by idler rollers 56 and 58 secures the signature between the diverter belts 16, 18. The soft nip 54 compressively captures and positively transports the signatures that pass therethrough. An additional idler roll 60 also helps direct the signatures through the diverter section 12.

Downstream of the diverter wedge 20, a first collator belt or tape 62 and a second collator belt or tape 64 circulate in separate continuous loops in the directions shown by the arrows in FIG. 1. The opposed collator belts 62 and 64 respectively share common paths with the diverter belts 16 and 18 along the collation paths 22 and 24. In particular, the first collator belt 62 is transported around the delivery roller 52, idler roll 66, roll 68 of the respective trailing edge signature slow down mechanism 46, idler roller 70, drive roll 72 and idler roll 74. The second collator belt 64 is transported around the delivery roller 52, snubber roller 76 of the respective trailing edge signature slow down mechanism 46, idler rollers 78, 80 and 82, drive roll 84, and idler roll 86. Idler rollers 88 and 90 also define the paths of the collator belts 62 and 64. Rolls 70 and 82 are belt take-up rolls and are movable to adjust the tension in each belt loop of belts 62 and 64. Rolls 72 and 84 drive the belts 62 and 64, respectively, around their continuous loops. The belts 62 and 64 may be driven at approximately the same speed as the belts 16 and 18 through the use of timing belts and timing pulleys (not shown), which are generally known to those skilled in the art.

Figure 2:
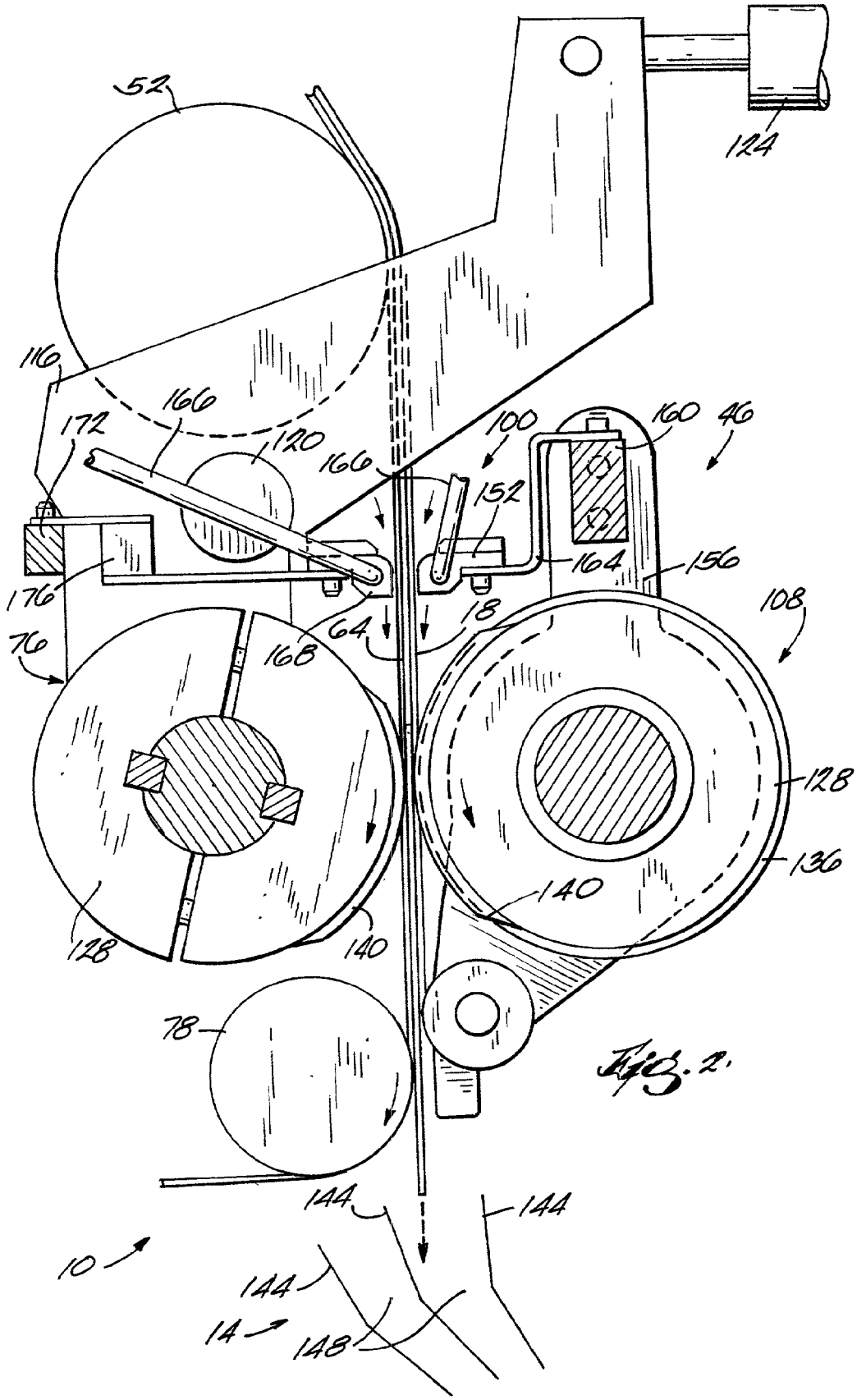
FIG. 2 is an enlarged view of a portion of FIG. 1.

Referring now also to FIG. 2, the delivery section 10 is illustrated in further detail and includes the signature slow down mechanism 46, and an air knife assembly 100. The delivery section 10 of FIG. 2 represents the right side delivery section 10 of FIG. 1. The left side delivery section 10 of FIG. 1 is similar to, and operates in substantially the same way as, the right side delivery system, thus, only the right side delivery system will be described further below.

The signature slow down mechanism 46 includes a main roller assembly 108, and the snubber roller assembly 76. The main roller assembly 108 is rotatably supported by the folder frame and is rotatably driven by the folder drive system as is known in the art. The snubber roller assembly 76 is supported by pivot arms 116 (only 1 pivot arm 116 is illustrated in FIG. 2) to be movable toward and away from the main roller assembly 108. The pivot arm 116 is pivotally supported by a pivot shaft 120 that is in turn supported by the folder frame. The pivot arm 116 is coupled to an air cylinder 124 that is operable to pivot the pivot arm 116 about the pivot shaft 120, thereby moving the snubber roller assembly 76 toward and away from the main roller assembly 108.

Figure 3:
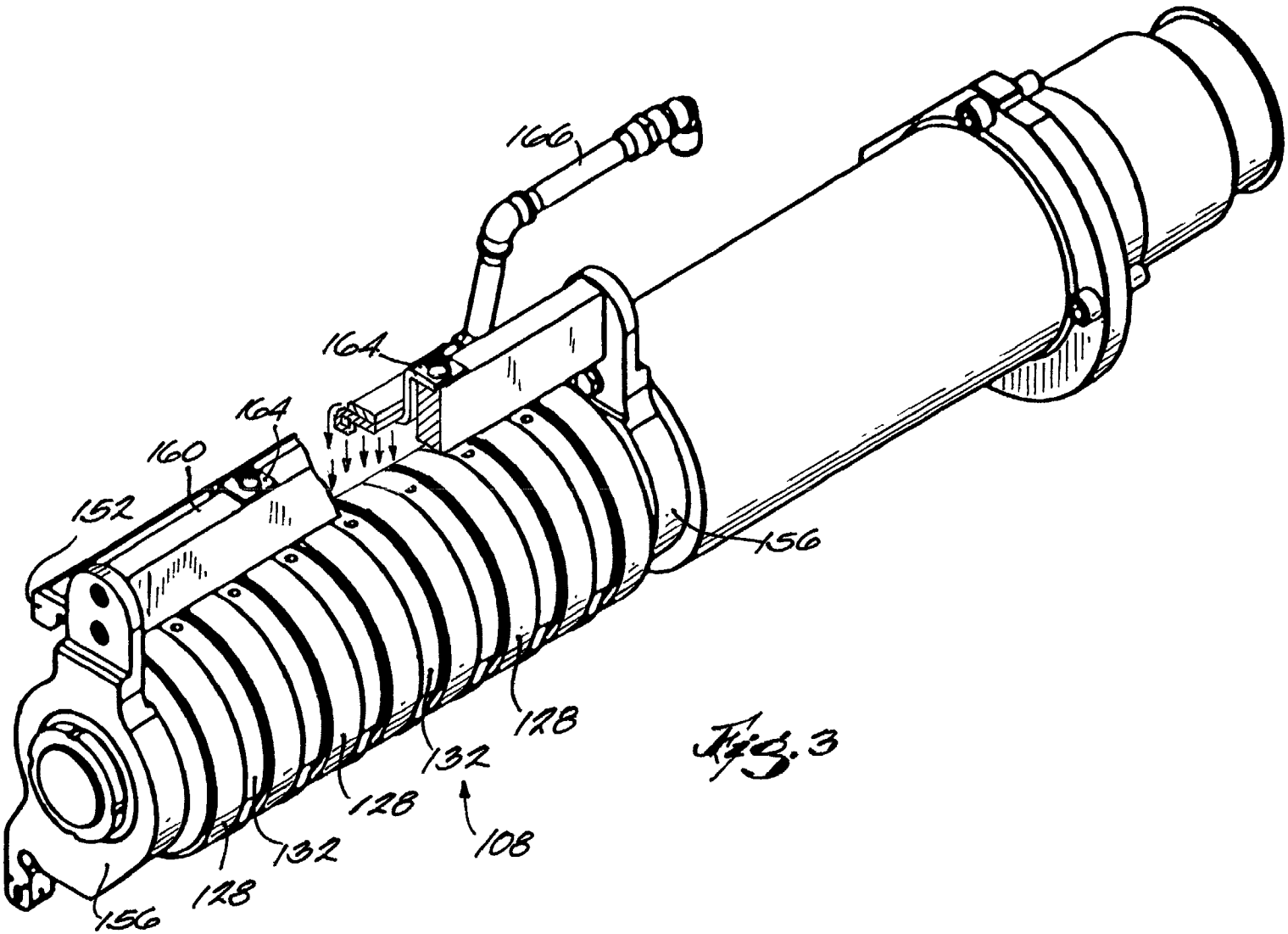
FIG. 3 is a perspective view of a portion of the slow down mechanism of FIG. 2.

Referring to FIG. 3, the main roller assembly 108 is illustrated. The main roller assembly 108 includes a plurality of axially spaced apart cams 128 that are mounted to the roller assembly 108 for rotation therewith. Between each cam 128 is a belt idler roller 132. The belt idler rollers 132 are rotatably mounted to the main roller assembly 108 such that the idler rollers 132 freely rotate with respect to the roller assembly 108. The diverter belts 18 are driven through the slow down mechanism 46 and engage the idler rollers 132. Because the idler rollers 132 are rotatable with respect to the roller assembly 108, the roller assembly 108 may be rotatably driven at a slower speed than the speed at which the belts 18 and 64 travel through the slow down mechanisms 46 for reasons that will become apparent below. It should be noted that although only the main roller assembly 108 is illustrated in FIG. 3, the snubber roller assembly 76 is configured in substantially the same way including axially spaced apart cams 128.

As shown in FIG. 2, as the belts 18, 64 enter the delivery section 10, the belts 18, 64 diverge from the signature travel path downstream of the delivery roller 52. Because the belts 18, 64 diverge, signatures traveling through the delivery section 10 substantially free fall through the space between the belts 18, 64. To slow the signatures down as they free fall, each cam 128 is provided with a cam protrusion 140. The cam protrusions 140 are configured such that as the roller assemblies 108, 76 rotate, the cam protrusions 140 intermittently and simultaneously extend into the space between the belts 18, 64 to grab the trailing edge of the signature. The rotation of the roller assemblies 108, 76 is such that the linear speed of the cam protrusions 140 is slower than the linear speed of the free falling signature, thus, when the cam protrusions 140 engage opposing sides of the signature, the speed of the signature is reduced.

Reducing the speed of the signature as described above substantially reduces the potential for damaging the signature as the signature is deposited into the fan delivery device 14. As illustrated in FIG. 2, the fan delivery device 14 includes a plurality of fan blades 144. The fan delivery device 14 is proportionally driven in a synchronous fashion with the folder such that each signature that passes through the delivery section 10 is deposited into a successive slot 148 defined by adjacent fan blades 144. As an individual signature contacts the fan blades 144 and subsequently settles within the slot 148, various types of damage may occur such as wrinkling or tearing of the signature. Slowing the signature down reduces the likelihood of damaging the signature as the signature enters and travels in the fan delivery device 14.

Continuing to refer to FIGS. 2 and 3, the air knife assembly 100 is shown which reduces the likelihood of damage to the signatures. The air knife assembly 100 includes a first air knife 152 upstream of and supported by the main roller assembly 108. The main roller assembly 108 includes end plates 156 that are pivotally mounted to the main roller assembly 108 but do not rotate with the main roller assembly 108. Extending between the end plates 156 is a cross bar 160. Air knife mounting brackets 164 are secured to the cross bar 160 and support the first air knife 152 in a generally cantilever fashion. An air supply line 166 extends from the first air knife 152 and communicates with a source of pressurized air (not shown).

The air knife assembly 100 further preferably includes a second air knife 168. The second air knife 168 is positioned on an opposite side of the signature travel path as the first air knife 152 and is supported by the pivot arms 116. A cross bar 172 extends between the pivot arms 116 and supports mounting brackets 176 that in turn support the second air knife 168. The second air knife 168 is substantially identical to the first air knife 152 and also includes an air supply line 166 communicating with the source of pressurized air. It is highly preferred that the brackets 164, 176 be configured to be adjustable, such that the position of the air knives 152, 168 may be adjusted with respect to the belts 18, 64.

Figure 4:
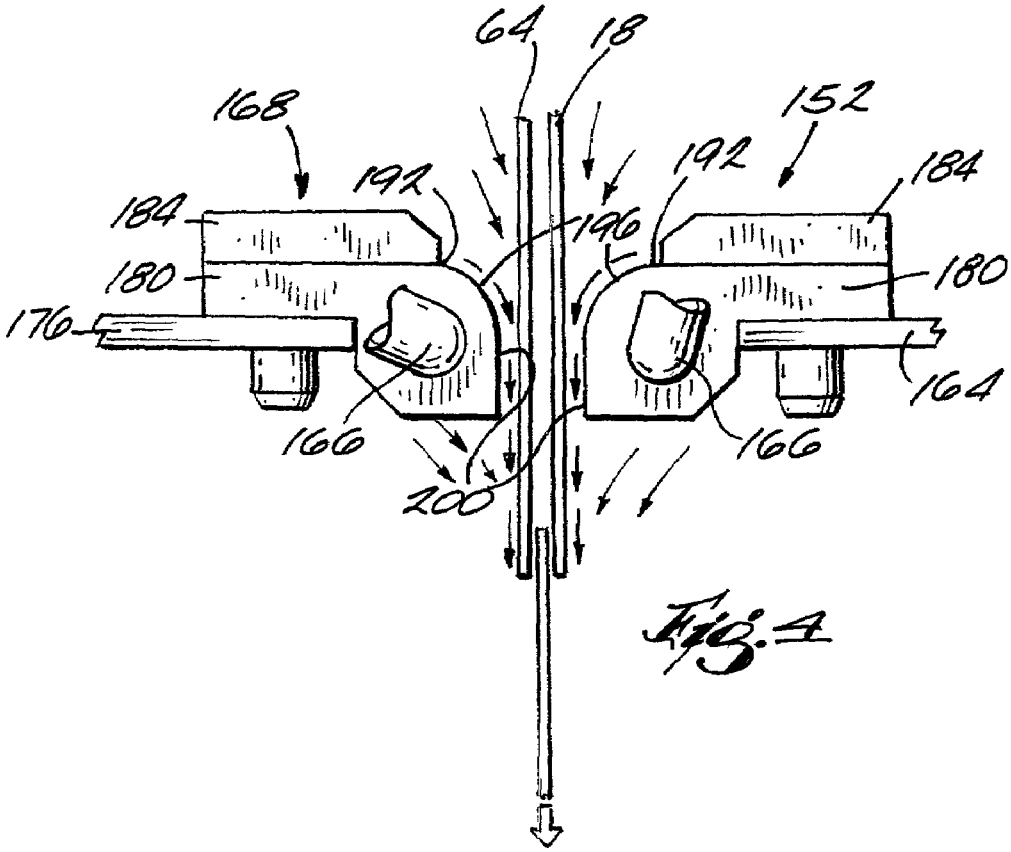
FIG. 4 is a side view of an air knife assembly.
Figure 5:
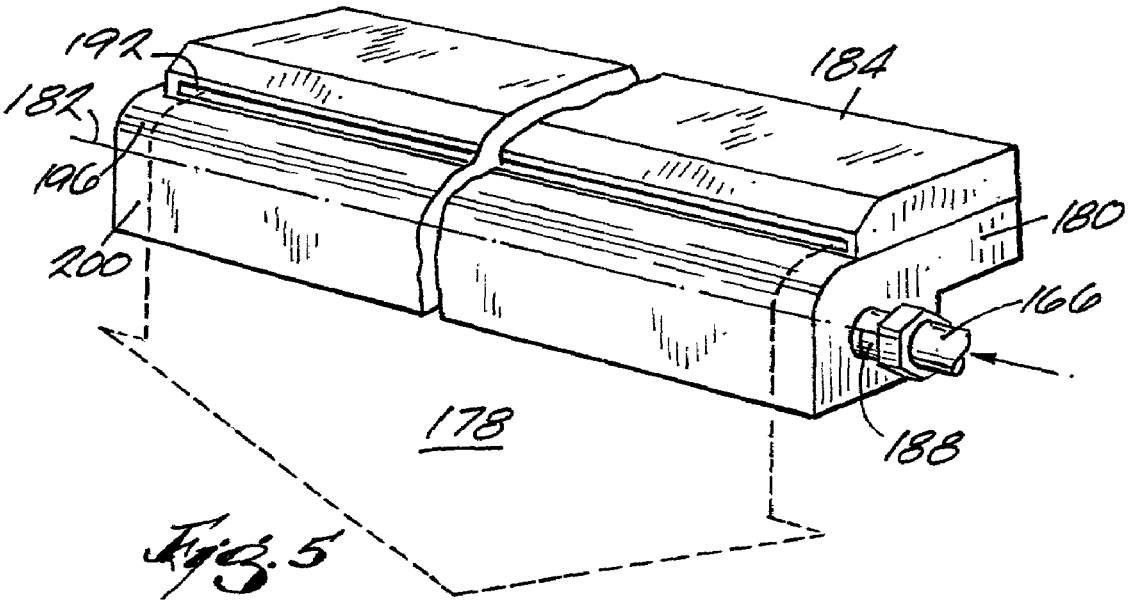
FIG. 5 is a perspective view of an air knife of the air knife assembly of FIG. 4.

Referring to FIGS. 4 and 5, while the specific construction, configuration and operation of various air knives may vary, air knives are generally configured to provide a substantially uninterrupted thin sheet 178 of highly concentrated moving air. The air knives 152, 168 include an elongated primary plenum 180 having a central axis 182, and a secondary plenum 184. The primary plenum 180 includes an intake 188 that communicates with the air supply line 166. Compressed air received by the primary plenum 180 is throttled through a thin nozzle 192 that extends the length of the air knife 152, 168 and is defined by the primary and secondary plenums 180, 184. Air exiting the nozzle 192 adheres to a curved portion 196 of the primary plenum 180 which turns the air approximately 90° and directs the flow along a face portion 200 of the primary plenum 180. As the air flows along the curved portion 196 and the face portion 200, surrounding air is entrained by the flow, resulting in a final air flow quantity that is greater than the air flow quantity exiting the nozzle 192. For example, an amplification ratio of approximately 30:1 at a distance of about 15 cm from each air knife can be utilized, however other ratios are also contemplated by the invention. An example of such an air knife 152, 168 is the Standard Air Knife™ available from EXAIR Corporation of Cincinnati, Ohio.

Referring back to FIG. 2, the air knives 152, 168 are positioned upstream of the slow down mechanism 46 but downstream of the delivery roller 52 and lie in a common plane that is generally perpendicular to the signature path. As the belts 18, 64 diverge from the signature path, the sheets of air 178 provided by the air knives 152, 168 guide the signature through the slow down mechanism and into the fan delivery device 14. The sheets of air 178 reduce the amount of fluttering of the signature and also minimize the opening of folded signatures as they travel through the delivery section 10, thereby reducing damage to the signatures as they are received by the fan delivery device 14.

The delivery of an individual signature through the delivery section 10 is discussed hereafter with reference to FIGS. 1 and 2. It should be appreciated, however, that the delivery section 10 is configured to handle a rapidly moving stream of successive signatures. An individual signature enters the delivery section at the arrow A and is subsequently gripped by the diverter belts 16 and 18 as the signature passes the idler rollers 56 and 58 and enters the nip 54. The signature is then diverted to one of the signature paths 22 or 24 by the diverter wedge 20. For the current example, the signature is diverted to the signature path 24. As the signature passes the diverter wedge 20, the signature is guided away from the diverter belt 16 and guiding control of the signature is assumed by the collator belt 64, which cooperates with the diverter belt 18. The signature passes the idler roller 50 and enters the signature slow down mechanism 46 where the air knives 152 and 168 are located.

As the signature passes the delivery roller 52, the belts 18 and 64 begin to diverge from each other, thereby releasing the signature. The positioning of the air knives 152, 168 is such that as the signature is released by the belts 18 and 64, the sheets of air provided by the opposed air knives 152 and 168 assume cooperative guiding control of the signature until the signature is received by the delivery device 14. In this respect, the signature travels past the air knives 152, 168 and between the snubber roller assembly 76 and the main roller assembly 108. Just prior to the trailing edge of the signature passing between the roller assemblies 76, 108, the cam protrusions 140 are rotated into position to grab the trailing edge and slow the signature down. The signature, still under the guiding control of the sheets of air provided by the air knives 152, 168, then travels past the idler roll 78 and is delivered into one of the slots 148 of the delivery device 14. The signature is then delivered to further downstream processing equipment.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A delivery section of a folder of a printing press, said delivery section comprising:

a delivery roller;

an idler roller downstream of said delivery roller;

a first and second set of belts engaging said rollers and at least partially defining a signature conveying path having a first side and a second side, the signature conveying path adapted to transport a single stream of signatures, said first and second set of belts diverging from each other downstream of said delivery roller;

a first air knife positioned adjacent said first side of said signature conveying path between said delivery roller and said idler roller;

a second air knife positioned adjacent said second side of said signature conveying path between said delivery roller and said idler roller, said first and second air knives each including a nozzle that forms a continuous sheet of moving air as the air exits the nozzle, the continuous sheet of moving air directed to travel substantially parallel to said signature conveying path; and a plurality of rotating delivery buckets positioned downstream of said idler roller and configured to receive signatures;

wherein folded signatures are conveyed along said signature conveying path, and wherein when said first and second set of belts diverge from each other, said continuous sheets of moving air guide the folded signatures past the idler roller and into the delivery buckets and maintain the folded signatures in a shut configuration.

2. The delivery section of claim 1, wherein said first and second air knives lie in a common plane that is substantially perpendicular to said signature conveying path.

* * * * *